US006126351A

United States Patent [19]

Gueret

[11] Patent Number: 6,126,351

[45] Date of Patent: Oct. 3, 2000

[54] LIPSTICK HOLDER AND LIPSTICK CASE COMPRISING SAME

[75] Inventor: Jean-Louis Gueret, Paris, France

[73] Assignee: L'Oreal, Paris, France

[21] Appl. No.: 09/101,801

[22] PCT Filed: Jan. 23, 1998

[86] PCT No.: PCT/FR98/00121

§ 371 Date: Dec. 1, 1998

§ 102(e) Date: Dec. 1, 1998

[87] PCT Pub. No.: WO98/33412

PCT Pub. Date: Aug. 6, 1998

[30] Foreign Application Priority Data

Jan. 31, 1997 [FR] France ..... 97 01103

[51] Int. Cl.[7] ..... A45D 40/02

[52] U.S. Cl. ..... 401/87; 401/78

[58] Field of Search ..... 401/78, 87, 77, 401/75, 76, 68

[56] References Cited

U.S. PATENT DOCUMENTS

| | | | |
|---|---|---|---|
| 2,838,169 | 6/1958 | Grau | 401/87 X |
| 3,380,795 | 4/1968 | Gruska | 401/78 |

FOREIGN PATENT DOCUMENTS

| | | | |
|---|---|---|---|
| 576482 | 8/1924 | France | 401/78 |
| 909021 | 4/1946 | France | 401/78 |
| 92615 | 12/1968 | France | 401/87 |
| 8915516 | 11/1990 | Germany | 401/78 |
| 78178 | 10/1947 | Japan | 401/87 |
| 2143212 | 2/1985 | United Kingdom | 401/78 |

*Primary Examiner*—David J. Walczak
*Attorney, Agent, or Firm*—Oblon, Spivak, McClelland, Maier & Neustadt, P.C.

[57] ABSTRACT

A lipstick holder for supporting a stick of solid product subject to crumbling. The holder is mounted for sliding in a case. It includes a cylindrical wall which forms a stick supporting skirt for maintaining the stick base, a transverse bottom and a device for retaining the stick. A slot is provided in the cylindrical wall which extends to the bottom and is delimited by two side edges linked by an upper edge opposite the bottom. The opening includes the device for retaining the stick.

21 Claims, 4 Drawing Sheets

LIPSTICK HOLDER AND LIPSTICK CASE COMPRISING SAME

BACKGROUND OF THE INVENTION

1. Field of the Invention

The present invention relates to a stick holder cup capable of supporting a stick of a solid, friable product and intended to be slidably mounted in a case, as well as a case for a product comprising such a cup. This stick of the product is, for example, a colored or non-colored lipstick, or any kind of stick, for example a dermatological stick.

2. Discussion of the Background

The known lipsticks have been satisfactory as long as the user takes the precaution of arranging them in such a way that in the storage position, the top of the stick is directed upwards. In practice when, for example these sticks are arranged in the user's handbag, it is practically impossible to observe this precaution. The result is that, in particular because of shocks and vibrations, the stick tends to emerge from the cup. It should, moreover, be noted that this effect is the more pronounced when the stick is subjected to temperature variations. Indeed, when certain types of stick are exposed to a temperature of 30°, the expansion of its diameter may reach 0.6 to 0.7 mm as compared with its normal diameter at the ambient temperature. The consequence is that following a fall in temperature, embrittlement occurs at the base of the stick. Thus the hold of the stick in a conventional cup is somewhat illusory, because there is the risk that it will subsequently become detached therefrom at the slightest shock.

A lipstick case is known, for example from FR-A-2 548 880, comprising a cup provided on the opposite side to its bottom with elastic tabs for fastening the stick in an undercut manner. These tabs bear against an internal side of the shell of the case. However this cup has the drawback that, when it slides in the case, its tabs are subjected to vibrations because of imperfections of this internal side of the case. The vibration of the tabs then produces a deformation of the base of the stick which is in contact with these tabs. Subsequently, the hold of the stick in the cup is no longer ensured, and there is the risk that the stick will become detached from the cup at the slightest shock. Moreover, the deformation of the base of the stick also occurs when the cup/stick unit is being mounted in the case. This phenomenon is all the more pronounced when the composition of the stick is of a pasty consistency.

Moreover, from FR-A-909 021 a lipstick case is known which is provided with a cup whose side wall has a slot extending over the whole height of the cup. Although this slot improves the sliding quality of the cup in the case, this slot produces a weakening of the hold of the stick in the cup.

SUMMARY OF THE INVENTION

A first object of the present invention is thus to propose a cup for a lipstick product which ensures a suitable retention of the stick in the cup in all positions of the stick and at variable temperatures.

Another object of the invention is to propose a cup that is simple and inexpensive to make, which moreover, allows an easy industrial positioning of the stick in the cup, and this irrespective of the composition of the stick.

Finally, a third object lies in proposing a cup having a diameter greater than that of the stick, which makes it possible to avoid any risk of breakage of the stick at the level of the base after the stick has been mounted in the cup.

Thus a first aspect of the invention relates to a stick holder cup capable of supporting a stick of a solid, friable product and intended to be slidably mounted in a case, comprising a substantially cylindrical wall provided with an axis of symmetry and constituting a skirt for holding the stick, intended to hold the base of the stick in position; a transverse bottom; and means for retaining the stick, there being formed in the cylindrical wall at least one opening extending as far as the bottom and being delimited by two side edges joined by an upper edge opposed to the bottom, this opening constituting the means for retaining the stick. This opening also constitutes a means for evacuating an excess of the product displaced by the retaining means and/or by the internal side during the positioning of the stick in the cup.

The term "substantially cylindrical wall" is understood to mean any cylindrical wall within the proper meaning of the term, or a slightly frustoconical wall diverging on its internal side towards its free edge on the opposite side to the bottom. Moreover, this free edge may have a bevel cut according to the shape of the case intended to contain this cup. If required, the bottom of the cup may be perforated.

Generally, the cup has a (circular) oval or prismatic cross-section. Most frequently, a cylindrical shape is preferred.

Advantageously, the cylindrical wall is extended beyond the transverse bottom by a cylindrical guide skirt joined to the bottom in alignment with the cylindrical wall, this skirt ensuring smooth sliding of the cup when it is mounted in a lipstick case.

According to a particular embodiment of the invention, the opening cut in the cylindrical wall is a longitudinal slot with an orientation parallel to the axis of the cup. It is, however, possible to make an opening of a rectangular shape or in the shape of a circular arc. If required, this opening may also pass through a portion of the bottom of the cup.

Advantageously, a plurality of openings (or slots) are provided which are regularly distributed over the circumference of the cylindrical wall. Thus the openings (or slots) pass through the whole height of the guide skirt, defining a plurality of tongues. Advantageously, the free ends of the tongues have a diameter that is slightly greater than the diameter of the cylindrical wall. Thus, these tongues can carry an external centering boss for example. In this way, the tongues permanently ensure a flexible contact with the side of a sheath of the case, ensuring easy and clearance-free sliding of the cup in the case, performing the function of a shock absorber. In particular, during assembly, during carriage or during the manipulation of a lipstick case, this shock absorbing effect reduces or avoids the risks of fracture of the base of the stick.

Because of the respective disposition of the slots and tongues which has been described above, the cylindrical wall on the opposite side to the bottom has a continuous edge.

Advantageously, an anchorage means capable of entering into the base of the stick is associated with each opening (or slot).

According to a first variant of embodiment, each opening (or slot) cut in the cylindrical wall is surrounded by an extra thickness called a "gadroon". Advantageously, each gadroon has a rounded edge in the vicinity of the internal side of the holding skirt. On the side of the slot, the gadroon forms together with the internal cylindrical side an angle of substantially 90°. Advantageously, the extra thickness is of the order of 0.1 to 5 mm. By means of the arrangement of these gadroons, it is possible to reinforce the hold of the stick in the cup still further. In a zone for connection to the cylindrical wall, the gadroons have a rounded edge facilitating the industrial positioning of the stick in the cup. This positioning of the stick is advantageously effected at a temperature lower than the ambient temperature, for example, at 10° C. At this temperature, the stick has a diameter smaller by some tenths of millimetres than the diameter which it has at the ambient temperature, and some tenths of millimetres smaller than the internal diameter of the cup. When returning to the ambient temperature, the stick expands and remains "anchored" in the slots and/or gadroons. During this expansion, a portion of the material constituting the stick is displaced and penetrates into the openings, thus ensuring the hold of the stick in the cup. The stick thus placed in position in the cup withstands falls and vibrations in a distinctly better way than a stick placed in a conventional cup, both at high temperatures and when cold.

According to another variant, it is also possible to dispose a gadroon of an appropriate shape between the slots.

According to another variant of the embodiment, the anchorage means is an elastically flexible part capable of radially bending towards the outside when the stick is being placed in position and of penetrating into the base thereof. Advantageously, this part is situated opposite an opening in the internal surface of the side wall of the cup or in the thickness thereof. This part may take the form of a fin, for example of a triangular or trapezoidal shape, orientated along a plane passing through the axis of the cup, a portion of one of the sides of the fin adjoining the internal side of the cylindrical wall. Advantageously, the shape of the fin is chosen so as to facilitate the insertion of the base of the stick into the cup.

Generally, the gadroons or the fins may be disposed over a variable height of the internal side wall of the cup.

If required, the cup has on its outside two projecting stubs intended to actuate the displacement of the cup when it is mounted in a case.

A second aspect of the present invention relates to a case for a product for the lips, comprising a stick whose base is engaged in a cup according to the first aspect described above. This cup is of the kind with two stubs radially projecting towards the outside and which, on the one hand, each pass through a slot, these slots being arranged in the side wall of a sheath wherein the cup moves substantially in the axial direction, and on the other hand each engage in a helical groove arranged in the internal side of a cylindrical sleeve externally sheathed by a shell, the sheath being movably mounted for rotation relative to the shell and retained in a fixed axial position. The axial distance separating the stubs from the edge of the cup on the one hand, and the axial position of the ends of the slots and/or of the grooves respectively in the sheath and/or the sleeve on the other hand, is such that when the stick is in its maximum extracted position, the edge of the cup does not emerge from the sheath.

BRIEF DESCRIPTION OF THE DRAWINGS

To render the present invention more readily understood, several embodiments of the cup in accordance with the invention will be described below by way of purely illustrative and in no way restrictive examples shown in the attached drawings.

DETAILED DESCRIPTION OF THE PREFERRED EMBODIMENTS

Figure 1:
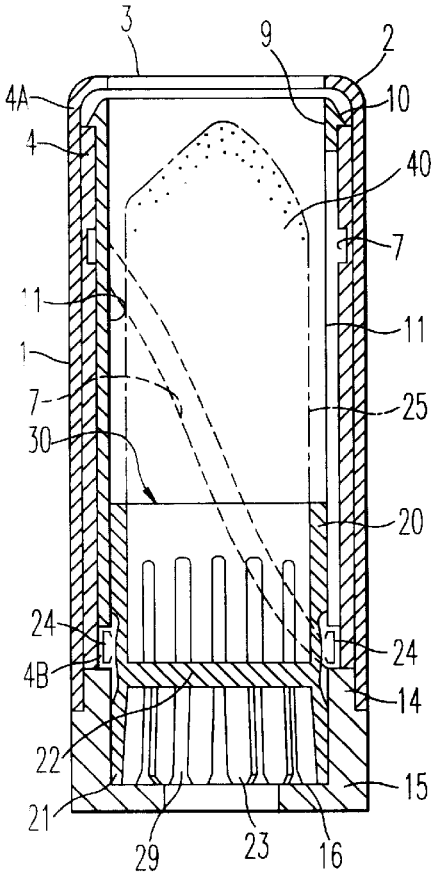
FIG. 1 shows an axial section of a lipstick case provided with a cup in accordance with the invention.
Figure 2:
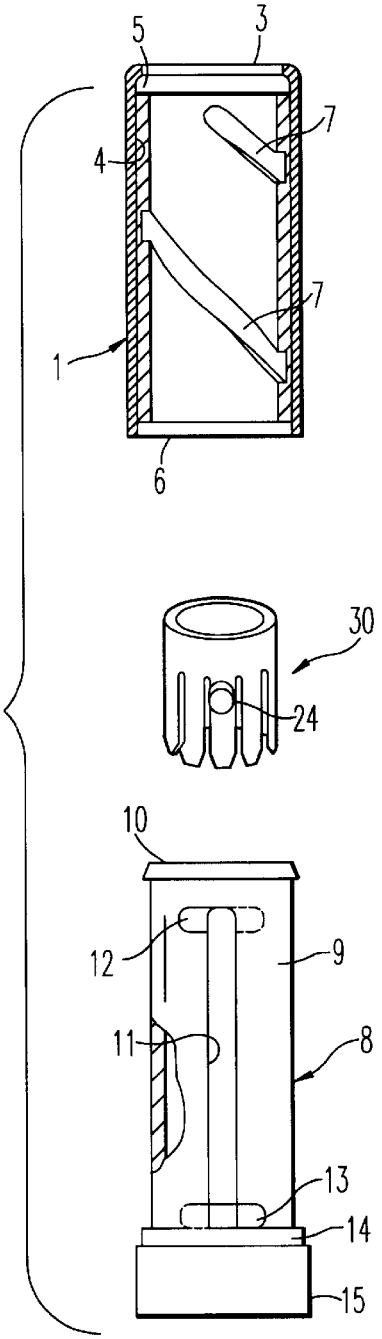
FIG. 2 shows an exploded view of the components of the case of FIG. 1, the stick not being shown for the sake of simplification.
Figure 3:
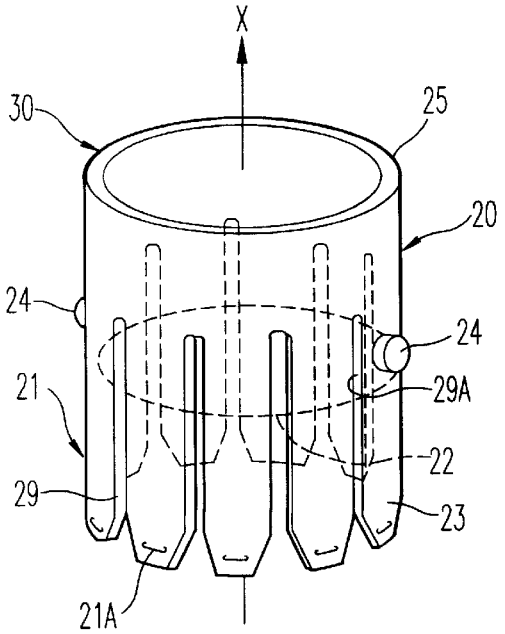
FIG. 3 is an enlarged view, in perspective, of the cup of FIG. 1.

Referring to FIGS. 1 to 3, there will be seen a case for a product for the lips, having a longitudinal axis X and comprising an external protective shell 1, for example a metal shell, of a cylindrical shape with a circular cross-section, one edge whereof is bent into a flange 2 rounded towards the axis X. It delimits a central circular passage 3. Inside the shell 1 there is fixed a thin circular cross-section cylindrical sleeve 4, made of a plastic material. It has a lower height than the shell 1, so as to form on the side of the flange 2 an annular chamber 5 delimited by this flange and by a first end 4*a* of the sleeve 4. On the opposite side to the flange 2, an annular setback 6 is delimited between the shell 1 and a second end 4*b* of the sleeve 4. Two helical grooves 7, identical but diametrically opposed, are arranged in the internal side of the sleeve 4.

In the unit formed by the shell 1 and the sleeve 4 there is mounted a sheath 8 made of a rigid plastic material, for free rotation round the axis X, but fixed in its axial position. The sheath 8 has a tubular cylindrical median part 9 with an external diameter slightly smaller than the internal diameter of the sleeve 4. At its ends, this sheath respectively comprises a retaining bead 10 and a manipulating end fitting 15.

Two identical, diametrically opposed, longitudinal slots 11 extend axially over virtually the whole height of the tubular part 9. Each slot has two ends which respectively terminate in a side notch 12 and 13. Relative to the slot 11, the notch 12 situated at a first end of a slot 11 is orientated in the opposite direction to the notch 13 situated at the second end of the slot 11.

At its end opposite the setback 6, the tubular part 9 is joined via an external radial shoulder 14 to a cylindrical manipulating end fitting 15 whose internal diameter is equal to the internal diameter of the tubular part 9 and whose external diameter is virtually equal to the diameter of the shell 1. At its free end, the end fitting 15 has an internal radial flange 16.

When the tubular part 9 is disposed in the sleeve 4, the annular retaining bead 10 (FIG. 1), abuts against the end 4*b* of the sleeve 4 and is engaged in the chamber 5, ensuring the axial hold of the sheath in the sleeve 4. Similarly, the external radial shoulder 14 is accommodated in the annular setback 6, so that the sleeve 4 is axially sandwiched between the bead 10 and the shoulder 14. Thus the sheath can be driven in rotation in the sleeve 4 by manipulating the manipulating end fitting 15.

In accordance with the invention, a cup 30 of a generally cylindrical shape is mounted in the sheath 8. This cup 30 has a cylindrical wall 20 and a cylindrical guide skirt 21 separated from one another by a bottom 22. On its external side wall, the cylindrical wall 20 has two stubs 24 projecting towards the outside. Each stub has a dimension such that it can pass through a slot 11 of the sheath 8 and be engaged in a groove 7 of the sleeve 4.

In the side of the cylindrical wall 20 there are cut, substantially halfway up, longitudinal slots 29 parallel to the axis X, opening in the direction towards the bottom 22 and passing through the whole height of the side of the guide skirt 21. Thus a plurality of elongate openings 29*a* is defined in the cylindrical wall 20, serving as an anchorage means when the stick 40 is placed in position.

As for the guide skirt 21, the slots 29 define tongues 23. Thanks to the material constituting the cup 30, for example, polyacetal, polystyrene or polypropylene, these tongues 23 have sufficient elasticity to guide the cup in a flexible manner during its axial travel in the sheath 8. Advantageously, bosses 21*a* are provided on the external side of each tongue 23 intended to suppress any possible play between the cup 30 and the sheath 8.

It will be understood that when the sheath is caused to rotate relative to the sleeve 4 and shell 1 round its longitudinal axis X, thanks to the guidance of the stubs 24 in the slots 11 and the grooves 7, the cup 30 is axially displaced in the tubular part 9 of the sheath 8. The rotation of the sheath produces an axial translation of the cup in the helical grooves 7 of the sleeve 4 between two end positions, one of which is the retracted position of the stick shown in FIG. 1. In this retracted position of the cup 30, the guide skirt 21 is accommodated inside the end fitting 15 in the vicinity of the internal flange 16.

Figure 4:
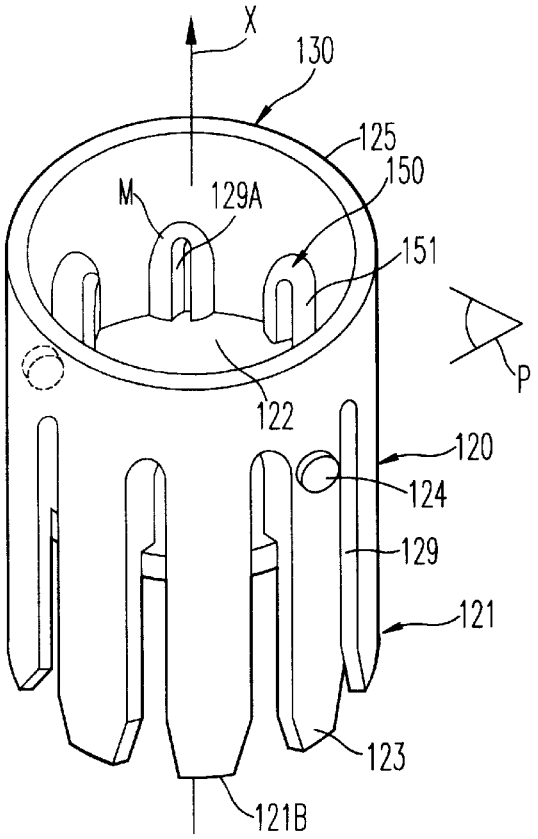
FIG. 4 is a view in perspective of a variant of the embodiment of the cup in accordance with the invention.
Figure 5:
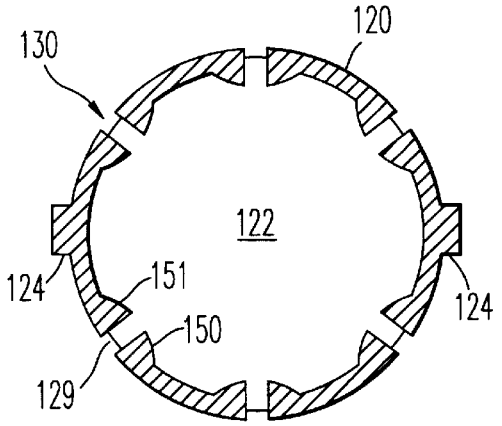
FIG. 5 is a section along plane P of FIG. 4.
Figure 6:
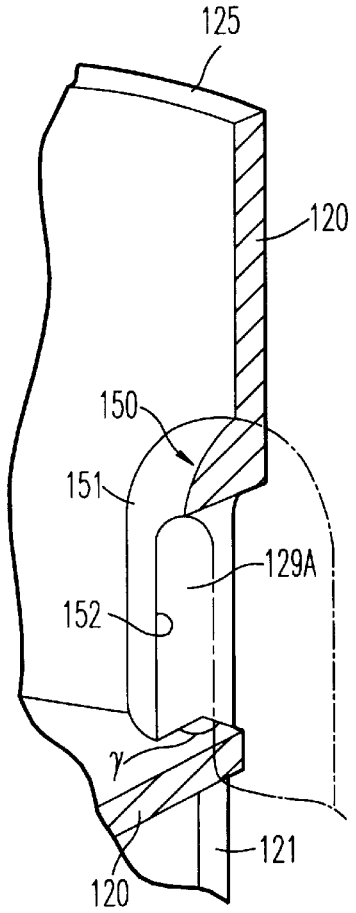
FIG. 6 is a partial enlarged view, in perspective, of FIG. 5 in an axial section.

FIGS. 4 to 6 illustrate a variant of the embodiment of the cup of FIG. 3. The parts constituting this cup which are the same as those of FIG. 3, or perform a similar function, bear the same reference numerals increased by 100. The description of these parts will be only partially repeated.

In a way similar to the embodiment of FIG. 3, the cup 130 of FIG. 4 has a substantially cylindrical shape. The cylindrical wall 120 and the guide skirt 121 have slots 120 opening substantially from half-way up the cylindrical wall 120 as far as the free end 121*b* of the guide skirt 121. Thus a plurality of elongate openings 129*a* is formed in the lower portion of the cylindrical wall 120. On the internal side of the cylindrical wall 120, each opening 129*a* is surrounded by a reinforcing zone or "gadroon" with an extra thickness 150. This extra thickness 150 is of the order of 0.6 mm. The external edge 151 of the extra thickness 150 is rounded off so as to facilitate the positioning of the stick in the cup 130, as may be seen in FIG. 5 which shows a cross-section along plane P of FIG. 4.

On the side of the slot 129, the opening 129*a* forms together with the cylindrical wall an acute angle $\gamma$ substantially equal to 90° as shown in FIG. 6.

The gadroons 150 form an excellent anchorage means for a stick of a semi-solid consistency, ensuring the hold of the stick, in particular at high temperatures around 30°.

Figure 7:
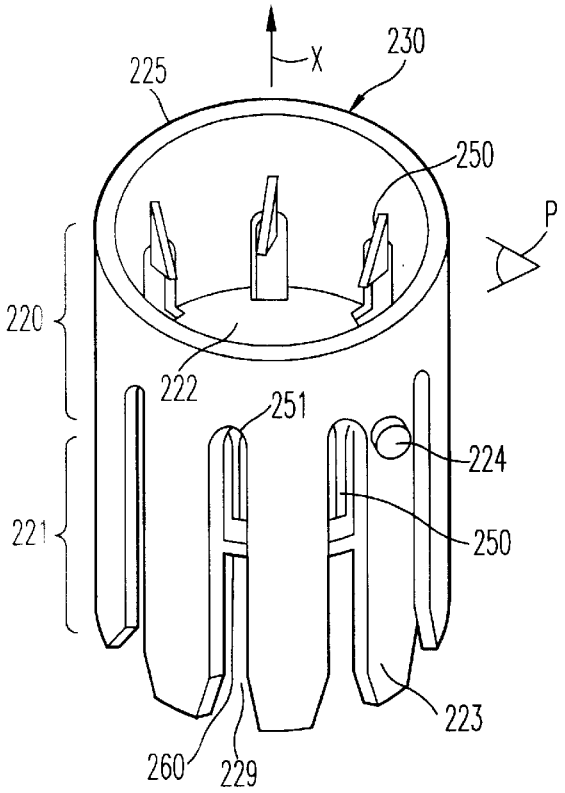
FIG. 7 is a view, in perspective, of another variant of the cup in accordance with the invention.
Figure 8:
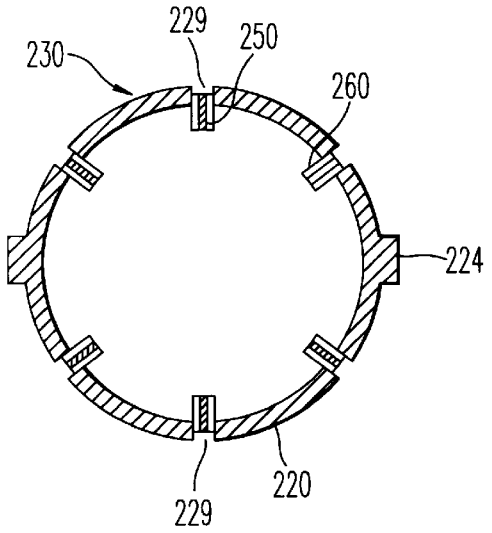
FIG. 8 is a section along plane P of FIG. 7.
Figure 9:
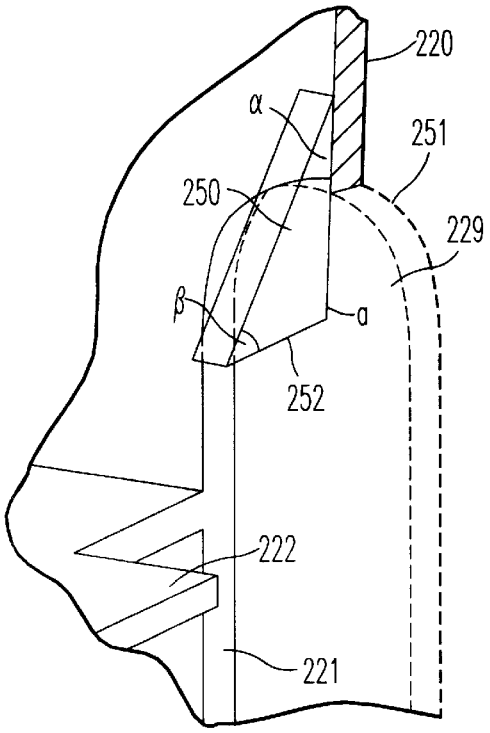
FIG. 9 is a partial enlarged view, in perspective, of FIG. 7, illustrating a variant of the means for fastening the stick.

FIGS. 7 to 9 illustrate another variant of the cup 230.

The parts constituting this cup which are the same as those of FIG. 3, or perform a similar function, bear the same reference numerals increased by 200. The description of these parts will be only partially repeated.

The cup 230 differs from the cup 30 of FIG. 1 in that the cylindrical wall 220 has a plurality of internal anchorage fins 250. These fins 250 have the shape of a right-angled triangle and extend radially towards the inside of the cup. They are attached to the cylindrical wall 220 at a level situated above the top 251 of each slot 229, so that an acute angle $\alpha$ is defined between the skirt 220 and the hypotenuse of the triangle. The angle $\alpha$ is typically from 20° to 45°. Over only a part of its length, the side adjoining the angle $\alpha$ is joined to the cylindrical wall 220. This design makes it possible to obtain an elastically movable arrangement of the fins 220. It will be appreciated that when the stick is being mounted in the cup, the fins 250 can be bent radially outwards in the space left by the slots 229. After the stick has been placed in position, the fins return into the base of the stick by resilience, ensuring the hold and anchorage thereof in the cup.

As for the bottom 222, in the extension of each slot 220 there have been arranged, in the bottom 222, notches 260 serving for the withdrawal of the moulding pins shaping the slots 229 and the base 252 of the fins 250.

Figure 10:
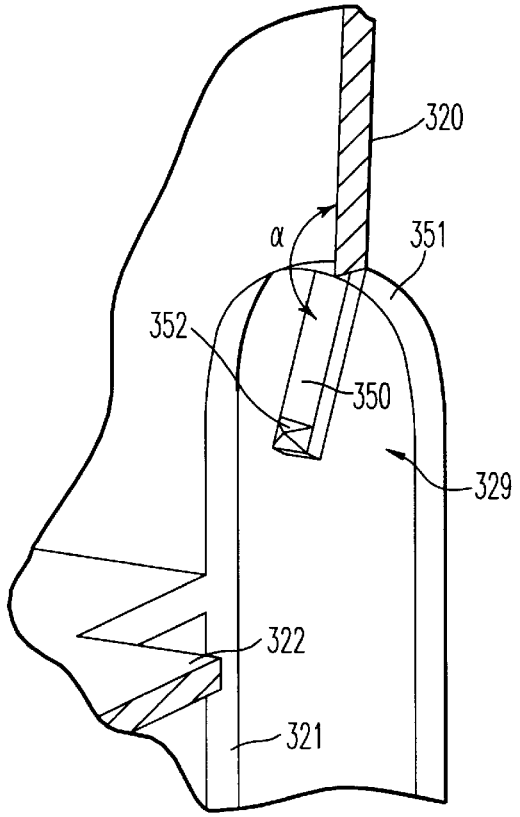
FIG. 10 is a partial enlarged view, in perspective, of a variant of the embodiment of the fastening means of FIG. 9.

FIG. 10 shows a different arrangement of the means for attaching the stick. In FIG. 10, the upper edge of the opening 329 which is cut into the side wall 320 carries a tongue 350. This tongue is radially flexible. It is directed towards the bottom 322 of the cup and orientated along an obtuse angle $\alpha$ towards its inside. The free end 352 of the tongue carries an anchorage tip. When the stick is being introduced into the cup, the tongue 350 is bent towards the outside and subsequently gradually enters into the mass of the stick, thanks to the pasty consistency of the stick. The anchorage tip 352 increases the hold of the stick still further and opposes any accidental emergence of the stick. The product displaced during this operation can then pass towards the opening 329.

Figure 11:
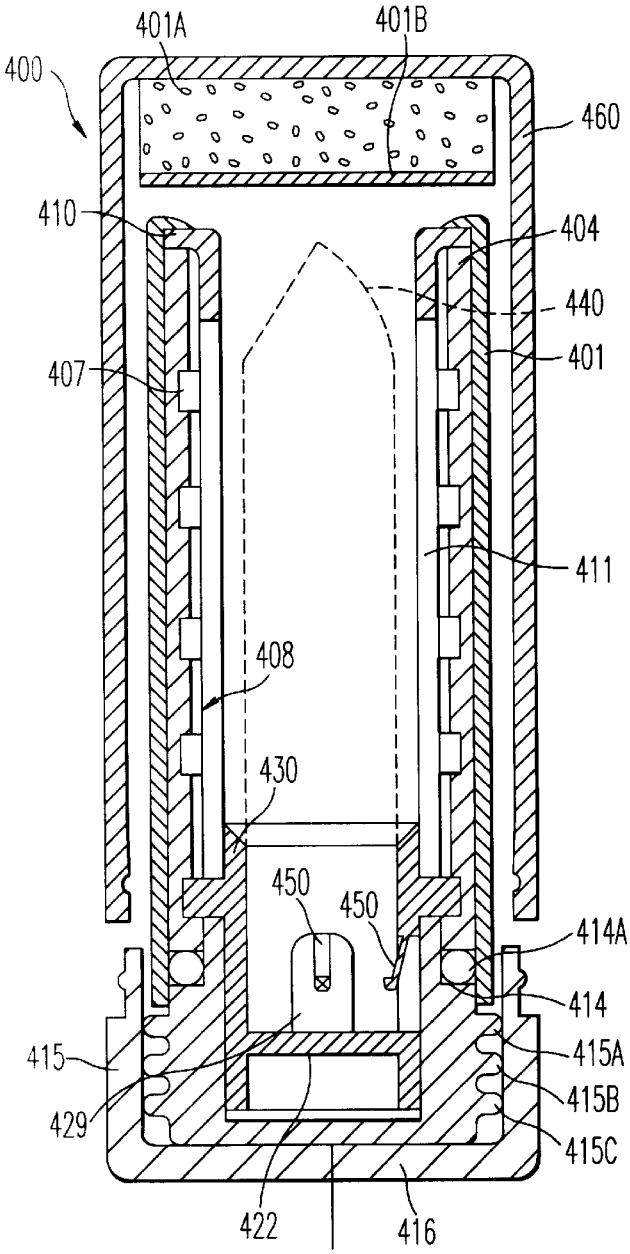
FIG. 11 is an axial sectional view of a preferred embodiment of a lipstick case.
Figure 13:
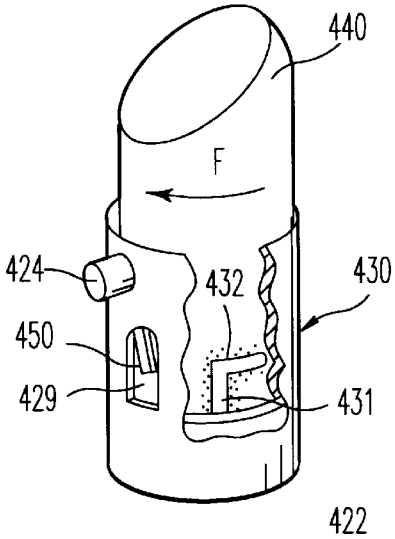
FIG. 13 shows a partly sectional view, in perspective, of a lipstick mounted in the cup of FIG. 11.
Figure 12:
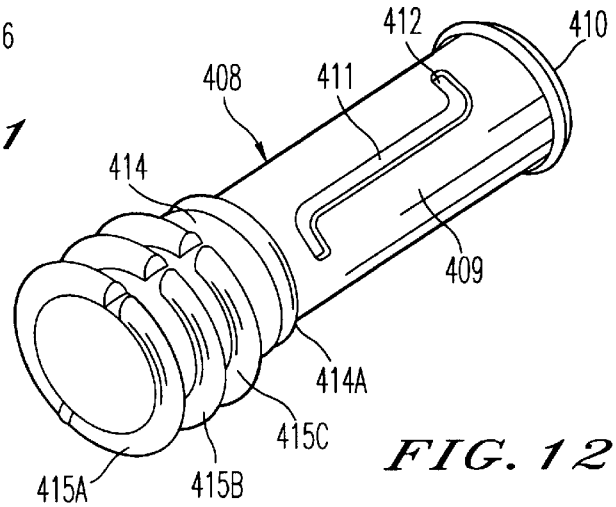
FIG. 12 shows a view, in perspective, of the sheath of FIG. 11.

FIGS. 11 to 13 illustrate a preferred embodiment of the invention showing a lipstick case. The parts constituting this cup which are the same as those of FIG. 1, or perform a similar function, bear the same reference numerals increased by 400. The description of these parts will be only partially repeated.

The case 400 of FIG. 11 has a cylindrical base 415 with a closed bottom 416 into which a cylindrical sheath 408 is fitted by force. The lower portion of this sheath is surrounded by three gadroons in the form of thin ring parts 415*a*, 415*b*, 415*c* extending radially towards the outside. These ring parts are discontinuous so as to increase their flexibility in the axial direction of the sheath, which facilitates the assembly of the mechanism. Two slots 411 situated opposite one another and being axially orientated, are cut in the cylindrical wall 409 of the sheath 408. The two stubs 424 of the cup 430 are disposed in these slots.

The cup 430 has substantially the same design as that shown in FIG. 10.

As may be seen, in particular in FIG. 12, the sheath has a shoulder 414 in the vicinity which there is disposed an O ring 414*a* made of an elastomeric material. The outer circumference of this ring 414*a* has a slight frictional contact with the internal lower portion of a cylindrical metal shell 401. In the upper portion of the metal shell 401, there is mounted a cylindrical sleeve 404 whose internal side is provided with two internal grooves intended to receive the stubs 424 of the cup 430 (see also FIG. 13). A lipstick 440 is mounted in the cup 430.

To protect the stick, this unit is closed by a cylindrical cap 460, at the bottom of which there is disposed a block of cellular foam 401*a* whose side turned towards the stick is covered by a flexible and leakproof film 401*b*. This foam block prevents an accidental emergence of the stick 440 during carriage and, moreover ensures the seal of the case, so as to reduce the drying out of the stick, if necessary.

FIG. 13 shows the arrangement of the stick 440 in the cup 430. When the stick is being introduced into the cup, the tongues 450 disposed at the top of the openings 429 create axially orientated paths 431 in the base of the stick. To increase the hold of the stick in the cup, the stick is caused to rotate in the direction of arrow F, for example through an angle of 10° or 20°. By means of this operation, the paths obtain a knee shape 432. The product displaced during this operation can escape through the openings 429 and contribute to the hold of the stick.

In all the versions of the embodiment the positioning of the stick in the cup is easy since, when compression of the base of the stick occurs during this operation, in particular by the fins 250, the tongues 350, 450 or the gadroons 150, any excess of the product can escape through the slots 29, 129, 229 of the cup 30, 130, 230 and thus contributes to the anchorage of the base of the stick in the cup. The cup of FIG. 3 is designed for fixing a stick of a relatively hard consistency; whereas the cups of FIGS. 4, 7, 10 and 13 can be used for supporting and holding a stick of a semi-solid consistency.

The invention is moreover particularly advantageous in that it makes it possible, because of the new system of mounting the stick, to have a stick whose diameter is very close to the diameter of the cup. This makes it possible to prevent the stick from being mounted askew in the cup. Thanks to the presence of the slots, the excess of the product displaced at the base of the stick by the internal side of the cup, and possibly by the gadroons when the cup is being placed in position, can be evacuated through the slots. Moreover, the invention applies both to conventional lipstick mechanisms and to lip pencils which have a more slender shape than the conventional mechanisms. In this case, the cup has no stubs on its external side wall, but is joined to a screw extending axially from the bottom of the cup. It will be duly understood that such a pencil can be used for dispensing any other friable product capable of being fixed in a cup, such as a kohl pencil for making up the eyes or a make-up chalk.

What is claimed is:

1. A stick holder cup capable of supporting a stick of a solid, friable product and intended to be slidably mounted in a case, comprising a cylindrical wall with an axis and constituting a skirt for holding the stick and for holding a base of the stick in position; a transverse bottom; and means for retaining the stick, at least one opening being cut in the cylindrical wall, characterized in that the said opening extends as far as the bottom and is delimited by two side edges joined by an upper edge opposed to the bottom, this opening constituting the means for retaining the stick.

2. A cup according to claim 1, characterized in that the cylindrical wall is extended beyond the transverse bottom by a cylindrical guide skirt joined to the bottom in alignment with the cylindrical wall.

3. A cup according to claim 2, characterized in that openings pass through the whole height of the cylindrical guide skirt so as to define a plurality of tongues.

4. A cup according to claim 3, characterized in that each tongue carries an external centering boss.

5. A cup according to claim 2, characterized in that the opening is a longitudinal slot with an orientation parallel to the axis.

6. A cup according to claim 1, characterized in that the opening is a longitudinal slot with an orientation parallel to the axis.

7. A cup according to claim 1, characterized in that a plurality of openings is provided, regularly distributed over the circumference of the cylindrical wall.

8. A cup according to claim 1, characterized in that said holder cup has a circular cross-section.

9. A cup according to claim 1, characterized in that the holding skirt has a continuous free edge on the opposite side to the guide skirt.

10. A cup according claim 1, characterized in that said holder cup has two projecting stubs on its outside, these stubs being intended to actuate the displacement of the cup.

11. A cup according to claim 1, characterized in that each opening in the internal side of the holding skirt is edged by an extra thickness.

12. A cup according to claim 11, characterized in that each extra thickness has a zone of a rounded shape for connection to the cylindrical wall.

13. A cup according to claim 11, characterized in that on the side of the slot, each extra thickness forms, together with the cylindrical wall, an angle of approximately 90°.

14. A cup (130) according to claim 11, characterized in that the extra thickness is of the order of 0.1 to 5 mm.

15. A cup according to claim 1, characterized in that with each opening there is associated an elastically flexible anchorage means, capable of bending radially towards the outside when the stick is being placed into position, and of penetrating into the base thereof.

16. A cup according to claim 15, characterized in that the anchorage means is situated opposite an opening on the internal surface of the cylindrical wall or in the thickness thereof.

17. A cup according to claim 15, characterized in that the anchorage means is a fin, a portion of one of the sides of the fin adjoining the internal side of the holding skirt, this fin being orientated along a plane passing through the axis of the cup.

18. A cup according to claim 15, characterized in that the anchorage means is a radially flexible tongue, one end whereof is joined to an edge of the opening.

19. A case for a product for the lips comprising a lipstick supported by a cup, comprising:

a cylindrical wall with axis and comprising a skirt for holding the stick, intended to hold the base of the stick in position;

a transverse bottom; and means for retaining the stick, at least one opening being cut in the cylindrical wall, wherein said opening extends as far as the bottom and is delimited by two side edges joined by an upper edge opposed to the bottom, said opening comprising the means for retaining the stick.

20. A case according to claim 19, characterized in that the cup has two stubs radially projecting outwardly and which each stub passes through a slot arranged in the side wall of a sheath wherein the cup moves substantially in the axial direction, and each stub engages in a helical groove arranged in the internal side of a cylindrical sleeve sheathed by a shell, the sheath being movably mounted for rotation relative to the shell and retained in a fixed axial position.

21. A stick holder cup capable of supporting a stick of a solid, friable product and intended to be slidably mounted in a case, comprising:

a cylindrical wall comprising a holding skirt intended to hold the base of the stick in position;

a transverse bottom positioned in said cylindrical wall so as to define a guide skirt on a side of the transverse bottom opposite the holding skirt; and at least one longitudinal slot cut in the guide skirt, wherein said slot crosses the bottom to said holding skirt and is delimited by two side edges joined by an upper edge.

* * * * *